US008657617B2

(12) United States Patent
Sunaga

(10) Patent No.: US 8,657,617 B2
(45) Date of Patent: Feb. 25, 2014

(54) ELECTRICAL CONNECTOR

(75) Inventor: Shiro Sunaga, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 100 days.

(21) Appl. No.: 13/467,167

(22) Filed: May 9, 2012

(65) Prior Publication Data

US 2012/0289097 A1 Nov. 15, 2012

(30) Foreign Application Priority Data

May 13, 2011 (JP) ..... 2011-108404

(51) Int. Cl.
*H01R 13/62* (2006.01)

(52) U.S. Cl.
USPC ..... 439/260; 439/495

(58) Field of Classification Search
USPC ..... 439/260, 495, 267
See application file for complete search history.

(56) References Cited

U.S. PATENT DOCUMENTS 5,904,586 A * 5/1999 Takayasu ..... 439/260
6,514,101 B1 * 2/2003 Miura ..... 439/495
6,935,888 B2 * 8/2005 Huang ..... 439/495
7,300,304 B1 * 11/2007 Takashita et al. ..... 439/495
7,473,125 B2 * 1/2009 Murakami ..... 439/495
2012/0144184 A1 * 6/2012 Niishino ..... 713/100

FOREIGN PATENT DOCUMENTS

JP 09-213416 8/1997

* cited by examiner

*Primary Examiner* — Gary F. Paumen
(74) *Attorney, Agent, or Firm* — Kubotera & Associates LLC

(57) ABSTRACT

An electrical connector for connecting a flat conductive member includes a housing that has a receiving portion for receiving the flat conductive member; a plurality of terminals; a movable member; and a regulating member. The regulating member is disposed between the movable member and the flat conductive member. Accordingly, it is possible to securely confirm that the flat conductive member is not completely inserted. When the movable member is moved to the closed position, the movable member pushes the regulating member, so that the entire portion of the movable member is moved. If the flat conductive member is situated at the incomplete insertion position, the regulating member abuts against the flat conductive member and stays at the middle position, so that the regulating member restricts the movement of the movable member.

7 Claims, 8 Drawing Sheets

ELECTRICAL CONNECTOR

BACKGROUND OF THE INVENTION AND RELATED ART STATEMENT

The present invention relates to an electrical connector for connecting a flat conductive member.

In a conventional electrical connector, a flat conductive member such as a flat cable and the like is inserted into the conventional electrical connector, so that the flat conductive member is connected to a terminal of the conventional electrical connector. When the flat conductive member is incompletely inserted into the conventional electrical connector before reaching a normal position, it is difficult to confirm that the flat conductive member is incompletely inserted. Accordingly, it is difficult to securely connect the flat conductive member to the terminal of the conventional electrical connector.

To this end, Patent Reference has disclosed a conventional electrical connector capable of solving the problem described above. The conventional electrical connector disclose in Patent Reference includes a housing having a through hole in both sidewalls thereof and an opening portion for receiving the flat conductive member. Further, in the conventional electrical connector, a detection piece is disposed in the through hole to be rotatable around a pin thereof when a leading edge of the flat conductive member thus inserted pushes the detection piece.

Patent Reference: Japanese Patent Publication No. 09-213416

In the conventional electrical connector described in Patent Reference, before the flat conductive member is inserted and pushes the detection piece, an end portion of the detection piece protrudes into the through hoe, and the other end portion of the detection piece protrudes from an outer side surface of the housing. When the flat conductive member is inserted up to the normal position, the leading edge and a side edge of the flat conductive member push the end portion of the detection piece, so that the detection piece is rotated around the pin thereof. Accordingly, the end portion and the other end portion of the detection piece are accommodated in the through hole, so that the end portion and the other end portion of the detection piece no longer protrudes. Afterward, a retainer is slid and moved along the outer side surface of the housing to be fixed, so that the retainer prevents the flat conductive member from coming off.

In the conventional electrical connector described in Patent Reference, before the flat conductive member is inserted up to the normal position, the detection piece is rotated only half ways. Accordingly, even when the leading edge of the flat conductive member pushes the end portion of the detection piece, the detection piece may be inclined, but the end portion and the other end portion of the detection piece may still protrude into the through hole.

In this state, the end portion of the detection piece still abuts against the leading edge of the flat conductive member. As a result, when the retainer is moved in this state, the retainer abuts against the other end portion of the detection piece, so that the retainer cannot be slid to an attachment position. Accordingly, an operation can recognize that the flat conductive member is not completely inserted into the conventional electrical connector, so that the operator can try to insert the flat conductive member one more time.

As described above, in the conventional electrical connector described in Patent Reference, when the flat conductive member is inserted into the opening portion of the housing, the leading edge of the flat conductive member pushes the detection piece. Accordingly, the flat conductive member tends to receive a reaction force from the detection piece when the flat conductive member abuts against the detection piece in the middle of the insertion. If the operator notices the reaction force, the operator may mistakenly recognize that the flat conductive member is completely inserted up to the normal position, thereby causing the incomplete insertion of the flat conductive member.

Further, in the conventional electrical connector described in Patent Reference, the flat conductive member is formed of a thin member with low rigidity. Accordingly, when the flat conductive member is inserted and abuts against the detection piece, the flat conductive member tends to easily deform due to the reaction force from the detection piece or other stress upon the insertion. If the flat conductive member inadvertently deforms, the flat conductive member may not securely pushes the detection piece, or may miss the detection piece and continues to move forward without pushing the detection piece.

When the situations described above occur, the end portion of the detection piece remains protruding into the through hole, and the other end portion of the detection piece remains protruding from the outer side surface of the housing. From an outer appearance, the operator can recognize that the retainer cannot be operated. Even if the flat conductive member is not completely inserted into the housing, if the operator forcibly moves the retainer, the detection piece is rotated while the flat conductive member is deformed. Accordingly, the operator may be able to operate the retainer.

As described above, in the conventional electrical connector described in Patent Reference, the detection piece tends to be situated at the unstable position, and it is difficult to accurately confirm that the flat conductive member is not completely inserted, or securely prevent the flat conductive member from being connected at the incomplete insertion position.

In view of the problems described above, an object of the present invention is to provide an electrical connector for connecting a flat conductive member capable of solving the problems of the conventional electrical connector. In the electrical connector of the present invention, it is possible to securely insert the flat conductive member without receiving the reaction force. Accordingly, it is possible to accurately confirm that the flat conductive member is not completely inserted, or securely prevent the flat conductive member from being connected at the incomplete insertion position.

Further objects and advantages of the invention will be apparent from the following description of the invention.

SUMMARY OF THE INVENTION

In order to attain the objects described above, according to a first aspect of the present invention, an electrical connector for connecting a flat conductive member includes a housing that has a receiving portion for receiving the flat conductive member; a plurality of terminals; a movable member; and a regulating member.

According to the first aspect of the present invention, the terminals are formed of a metal plate to maintain a flat plate surface thereof, and are arranged and held in the housing in an arrangement direction thereof perpendicular to the flat plate surface. Each of the terminals includes a contact portion for contacting with the flat conductive member that is inserted into the receiving portion of the housing in a front direction.

According to the first aspect of the present invention, the movable member is disposed to be movable between an opened position and a closed position. When the movable member is situated at the opened position, the receiving portion is opened, so that the flat conductive member can be inserted into the receiving portion toward a normal position. When the movable member is situated at the closed position, the movable member presses the flat conductive member against the contact portions of the terminals after the flat conductive member is inserted.

According to the first aspect of the present invention, the regulating member is disposed for allowing the flat conductive member to be inserted up to the normal position when the movable member is situated at the opened position. Further, the regulating member is disposed for regulating a movement of the movable member toward the closed position when the flat conductive member does not reach the normal position and is situated at an incomplete insertion position.

According to the first aspect of the present invention, the regulating member is supported on the housing to be movable between a first position corresponding to the opened position of the movable member and a second position corresponding to the closed position of the movable member through a rotation, a parallel movement, or a combination thereof of an entire portion of the regulating member.

According to the first aspect of the present invention, the regulating member includes a pressed portion to be pressed with the movable member and an abutting portion for abutting against the flat conductive member situated at the incomplete insertion position at a middle position of the movement of the regulating member toward the second position when the movable member presses the pressed portion. When the abutting portion abuts against the flat conductive member, the regulating member restricts the movement of the movable member toward the closed position while the movable member presses the pressed portion of the regulating member situated at the middle position.

In the first aspect of the present invention, with the configuration described above, before the flat conductive member is inserted into the receiving portion of the housing, that is, the movable member is situated at the opened position, both the movable member and the regulating member are not situated in an insertion path of the flat conductive member, so that it is possible to insert the flat conductive member. In this state, after the flat conductive member is inserted up to the normal position, the movable member is operated to move from the opened position to the closed position. As a result, the movable member presses the pressed portion of the regulating member situated at the first position with a corresponding portion thereof. Accordingly, the regulating member is moved to the second position. At this moment, the abutting portion of the regulating member does not interfere with the flat conductive member.

In the first aspect of the present invention, when the flat conductive member does not reach the normal position and is situated at the incomplete insertion position, if an operator does not recognize the position of the flat conductive member and tries to operate the movable member to move toward the closed position, the movable member presses the pressed portion of the regulating member to move the regulating member toward the second position. At this moment, the abutting portion of the regulating member abuts against the flat conductive member situated at the incomplete insertion position, so that the regulating member stops at the middle position.

Accordingly, the movable member pressing the pressed portion of the regulating member does not move any further. At this moment, the operator visually confirms the position of the movable member and feels a reaction force of the movable member, so that the operator recognizes that the flat conductive member is situated at the incomplete insertion position, and tries to insert the flat conductive member one more time. The regulating member is formed to have rigidity far greater than that of the flat conductive member. Accordingly, when the regulating member regulates the movement of the movable member, as opposed to the case that the flat conductive member regulates the movement of the movable member as in the conventional electrical connector, it is possible to securely and stably regulate the movement of the movable member.

According to a second aspect of the present invention, the regulating member may include a shaft portion and a wing portion extending from the shaft portion in a radial direction of the shaft portion at a portion of the shaft portion in a circumferential direction thereof. The shaft portion has an axial line extending in an insertion direction of the flat conductive member, and is arranged to be rotatable around the axial line. The shaft portion includes a step portion formed in a step shape in the circumferential direction, and the step portion constitutes the pressed portion to be pressed with the movable member when the movable member is rotated. The wing portion includes a surface facing a surface of the flat conductive member situated at the incomplete insertion position, so that the surface constitutes the abutting portion.

In the second aspect of the present invention, in the regulating member with the configuration described above, the wing portion with the abutting portion formed thereon extends from the shaft portion in the radial direction of the shaft portion. Accordingly, a distance from the axial line to the abutting portion becomes greater than a distance from the axial line to the pressed portion, thereby increasing a leverage ratio of the abutting portion.

As described above, when the flat conductive member is situated at the incomplete insertion position, the abutting portion abuts against the flat conductive member, so that the regulating member receives the reaction force. At this moment, in order to operate the movable member to push the pressed portion of the regulating member so that the regulating member is rotated around the axial line, it is necessary to apply a pressing force, which is greater than the reaction force by a multiple number times of the leverage ratio of the distances, to the pressed portion.

In other words, the movable member receives the pressing force, which is greater than the reaction force received at the pressed portion from the flat conductive member by the multiple number times of the leverage ratio of the distances, from the pressed portion. As a result, the movable member is securely restricted to rotate any further toward the closed position.

In the second aspect of the present invention, with the configuration described above, the rotational axial line of the movable member is arranged to be perpendicular to the axial line of the regulating member. Accordingly, the movable member is arranged to move in a direction converted from that of the regulating member, thereby increasing flexibility in designing the inner configuration of the housing.

According to a third aspect of the present invention, the regulating member may include a rotational plate member, a first protruding portion, and a second protruding portion. The rotational plate member is situated on a side of the flat conductive member in a width direction of the flat conductive member. Further, the rotational plate member includes an axial line extending in the width direction, so that the rotational plate member is disposed to be rotatable around the axial line.

According to the third aspect of the present invention, the first protruding portion extends from one surface of the rotational plate member along the axial line at a first position shifted from the axial line in a radial direction of the rotational plate member. The second protruding portion extends from the other surface of the rotational plate member along the axial line at a second position shifted from the axial line in the radial direction. Further, the first protruding portion is configured to constitute the pressed portion, and the second protruding portion is configured to constitute the abutting portion.

According to the third aspect of the present invention, the first protruding portion and the second protruding portion are configured to protrude by an appropriate protruding amount. Accordingly, it is possible to properly adjust the distance from the axial line to the abutting portion relative to the distance from the axial line to the pressed portion. As a result, similar to the second aspect of the present invention, when the flat conductive member is situated at the incomplete insertion position, it is possible to securely regulate the movement of the movable member toward the closed position.

According to a fourth aspect of the present invention, the regulating member may include a linearly moving plate portion situated on a side of the flat conductive member in the width direction of the flat conductive member. The linearly moving plate portion is configured to move from the first position to the second position in the width direction to enter an engaging recess portion of the flat conductive member when the moving member presses the pressed portion.

According to the fourth aspect of the present invention, when the flat conductive member is situated at the incomplete insertion position, the abutting portion formed on the regulating member on the side of the second position abuts against the flat conductive member at a side edge thereof other than the engaging recess portion. Accordingly, the regulating member stays at the middle position, so that a first position side portion of the regulating member restricts the movement of the movement of the movable member toward the closed position.

According to the fourth aspect of the present invention, when the movable member is moved toward the closed position, the movable member pushes the pressed portion formed on the first position side, so that the regulating member is moved (linearly) toward the second position in the width direction of the flat conductive member. When the flat conductive member is inserted up to the normal position, the abutting portion formed on the second position side of the regulating member, so that the linearly moving plate portion enters the engaging recess portion of the flat conductive member. Accordingly, the first position side of the regulating member allows the movable member to move to the closed position.

On the other hand, when the flat conductive member is situated at the incomplete insertion position, the engaging recess portion of the flat conductive member is situated at a position on a front side in the insertion direction relative to the abutting portion of the regulating member. Accordingly, the abutting portion abuts against the side edge of the flat conductive member in front of the engaging recess portion, so that the regulating member stays does not reach the second position and stays at the middle position. As a result, the first position side of the regulating member prevents the movable member from moving the closed position, thereby restricting the movable member.

According to a fifth aspect of the present invention, the regulating member may include an engaging portion for engaging with an engaging recess portion having a cut shape or a window shape formed in a side edge of the flat conductive member. The engaging portion is configured to enter the engaging recess portion when the flat conductive member is inserted up to the normal position and the regulating member moves from the first position to the second position. Accordingly, the engaging portion is capable of engaging with the engaging recess portion in a pull-out direction of the flat conductive member.

According to the fifth aspect of the present invention, with the regulating member having the configuration described above, it is possible to securely confirm and prevent the incomplete insertion position of the flat conductive member. Further, when the flat conductive member is inserted up to the normal position, it is possible to prevent the flat conductive member from inadvertently being pulled off.

According to a sixth aspect of the present invention, an electrical connector for connecting a flat conductive member includes a housing that has a receiving portion for receiving the flat conductive member; a plurality of terminals; a movable member; and a regulating member.

According to the sixth aspect of the present invention, the terminals are arranged and held in the housing in an arrangement direction thereof. Each of the terminals includes a contact portion for contacting with the flat conductive member.

According to the sixth aspect of the present invention, the movable member is disposed to be movable between an opened position and a closed position. When the movable member is situated at the opened position, the receiving portion is opened, so that the flat conductive member can be inserted into the receiving portion toward the normal position. When the movable member is situated at the closed position, the movable member presses the flat conductive member against the contact portions of the terminals after the flat conductive member is inserted.

According to the sixth aspect of the present invention, the regulating member is disposed for allowing the flat conductive member to be inserted up to the normal position when the movable member is situated at the opened position. Further, the regulating member is disposed for regulating the movement of the movable member toward the closed position when the flat conductive member does not reach the normal position and is situated at the incomplete insertion position.

According to the sixth aspect of the present invention, the regulating member is formed as a component separated from the housing, and is supported on the housing or a member attached to the housing, so that an entire portion of the regulating member is capable of moving. Further, the regulating member includes a pressed portion to be pressed with the movable member and an abutting portion capable of protruding into the receiving portion. When movable member is moved from the opened position to the closed position, the movable member pushes the pressed portion, so that the abutting portion protrudes into the receiving portion.

According to a seventh aspect of the present invention, an electrical connector for connecting a flat conductive member includes a housing that has a receiving portion for receiving the flat conductive member; a plurality of terminals; a movable member; and a regulating member.

According to the seventh aspect of the present invention, the terminals are arranged and held in the housing in an arrangement direction thereof. Each of the terminals includes a contact portion for contacting with the flat conductive member.

According to the seventh aspect of the present invention, the movable member is disposed to be movable between an opened position and a closed position. When the movable member is situated at the opened position, the receiving portion is opened, so that the flat conductive member can be inserted into the receiving portion toward the normal position. When the movable member is situated at the closed position, the movable member presses the flat conductive member against the contact portions of the terminals after the flat conductive member is inserted.

According to the seventh aspect of the present invention, the regulating member is disposed for allowing the flat conductive member to be inserted up to the normal position when the movable member is situated at the opened position. Further, the regulating member is disposed for regulating the movement of the movable member toward the closed position when the flat conductive member does not reach the normal position and is situated at the incomplete insertion position.

According to the seventh aspect of the present invention, the regulating member is formed as a component separated from the housing, and is supported on the housing or a member attached to the housing, so that an entire portion of the regulating member is capable of moving. Further, the regulating member includes a return pressed portion to be pressed with the movable member when the movable member is returned from the closed position to the opened position. When the movable member pushes the pressed portion, the regulating member is moved to the first position.

According to the seventh aspect of the present invention, with the configuration described above, when the flat conductive member is pulled out as necessary, the movable member is operated to move toward the opened position. At this moment, the movable member pushes the return pressed portion of the regulating member, so that the regulating member is securely returned to the first position. Accordingly, it is possible to be ready for inserting the flat conductive member the next time.

As described above, in the present invention, the regulating member is disposed between the movable member and the flat conductive member. Accordingly, it is possible to securely confirm that the flat conductive member is not completely inserted. When the movable member is moved to the closed position, the movable member pushes the regulating member, so that the entire portion of the movable member is moved. If the flat conductive member is situated at the incomplete insertion position, the regulating member abuts against the flat conductive member and stays at the middle position, so that the regulating member restricts the movement of the movable member. As a result, it is possible to securely restrict the movable member with the regulating member having the rigidity greater than that of the flat conductive member or other elastic member. Therefore, it is possible to securely confirm and prevent the incomplete insertion of the flat conductive member.

BRIEF DESCRIPTION OF THE DRAWINGS

FIGS. 1(A) and 1(B) are perspective views showing an electrical connector in a state that a flat conductive member is not inserted into the electrical connector according to a first embodiment of the present invention, wherein FIG. 1(A) is a perspective view of the electrical connector in a state that a movable member is situated at an opened position and FIG. 1(B) is a perspective view of the electrical connector in a state that the movable member is situated at a closed position;

FIGS. 2(A) and 2(B) are perspective views showing a regulating member of the electrical connector according to the first embodiment of the present invention, wherein FIG. 2(A) is an enlarged partial view of a corresponding portion of the electrical connector, and FIG. 2(B) is a perspective view of the regulating member of the electrical connector;

FIGS. 3(A) to 3(C) are views showing the movable member and the regulating member of the electrical connector when the movable member is situated at the opened position and the regulating member is situated at a first position according to the first embodiment of the present invention, wherein FIG. 3(A) is a perspective view of the movable member and the regulating member, FIG. 3(B) is a partially broken front view of the movable member and the regulating member, and FIG. 3(C) is a partially broken side view of the movable member and the regulating member;

FIGS. 4(A) and 4(B) are views showing the movable member and the regulating member of the electrical connector when the movable member starts moving toward the closed position and the regulating member starts moving toward a second position according to the first embodiment of the present invention, wherein FIG. 4(A) is a perspective view of the movable member and the regulating member, and FIG. 4(B) is a partially broken front view of the movable member and the regulating member;

FIGS. 5(A) to 5(C) are views showing the movable member and the regulating member of the electrical connector when the movable member reaches the closed position and the regulating member is situated at the second position according to the first embodiment of the present invention, wherein FIG. 5(A) is a perspective view of the movable member and the regulating member, FIG. 5(B) is a partially broken front view of the movable member and the regulating member, and FIG. 5(C) is a perspective view of the regulating member while the movable member is omitted;

FIGS. 7(A) to 7(D) are perspective views showing a regulating member of the electrical connector according to the second embodiment of the present invention, wherein FIG. 7(A) is a perspective view of the regulating member, FIG. 7(B) is a perspective view of the regulating member situated at the first position and a flat conductive member situated at a normal position, FIG. 7(C) is a perspective view showing the regulating member situated at a second position and the flat conductive member situated at the normal position, and FIG. 7(D) is a perspective view showing the regulating member situated at a middle position and a flat conductive member situated at an incomplete insertion position.

DETAILED DESCRIPTION OF THE PREFERRED EMBODIMENTS

Hereunder, embodiments of the present invention will be explained with reference to the accompanying drawings.

First Embodiment

Figure 1B:
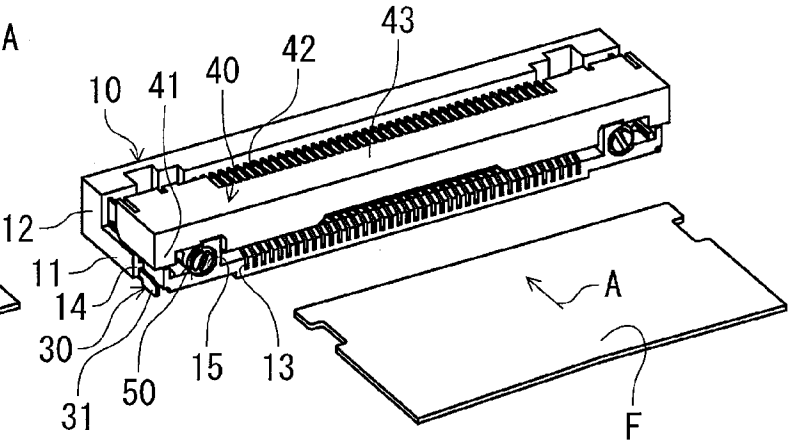
Figure 1A:
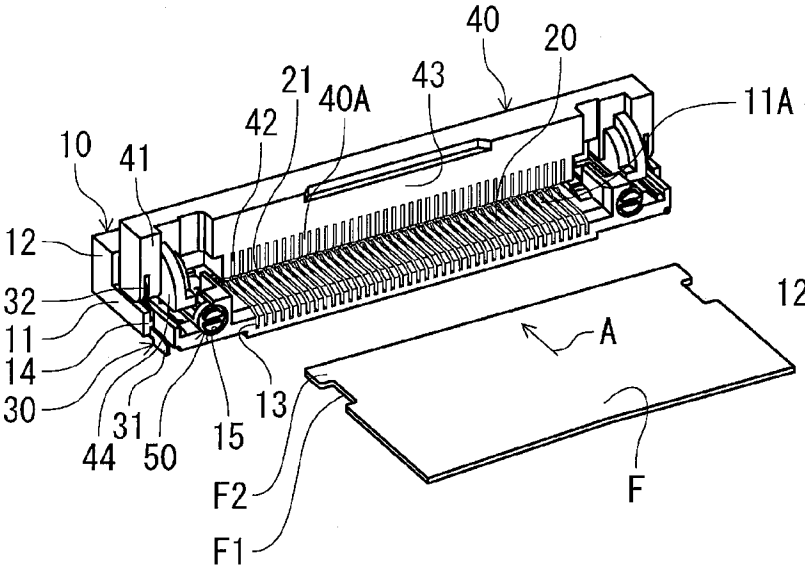

A first embodiment of the present invention will be explained. FIGS. 1(A) and 1(B) are perspective views showing an electrical connector (a connector) according to the first embodiment of the present invention. More specifically, FIG. 1(A) shows the connector with a movable member situated in an open position and FIG. 1(B) shows the connector with the movable member situated in a closed position.

As shown in FIG. 1(A), the connector 1 includes a housing 10; a terminal 20; a metal fitting 30; the movable member 40 and a regulation member 50. The housing 10 is made from an electrical insulating material. The terminal 20 and the metal fitting 30 are held in the housing 10. The movable member 40 is made from an electrical insulating material and movable against the housing 10. The regulation member 50 is made from an electrical insulating material and supported by the housing 10 so as to be movable. In the embodiment, the regulation member 50 and the movable member 40 characterize the present invention.

As shown in FIG. 1(B), when the movable member 40 is situated in the closed position, the housing 10 and the movable member 40 form a substantial rectangular shape elongated in a width direction of a flat conductive member F (a lateral direction or a width direction). As shown in FIG. 1(A), when the movable member 40 is situated in the open position, the movable member 40 is stood perpendicularly to the housing 10.

In the embodiment, the housing 10 includes a receptacle portion 11A for receiving the flat conductive member F inserted from a front side in a direction of an arrow A shown in FIGS. 1(A) and 1(B). The receptacle portion 11A includes a horizontal portion 11 extending to the front side and a vertical portion 12. The vertical portion 12 extends uprightly from a rear portion of the horizontal portion 11 so that the receptacle portion 11A has a side surface having an L-letter shape.

As shown in FIG. 1(B), the movable member 40 in the closed position is settled in a space formed along the horizontal portion 11 and the vertical portion 12. The receptacle portion 11A has a space formed with an upper surface of the horizontal portion 11 and an inner portion of the housing 10, extending in a rear direction.

In the embodiment, the housing 10 includes a plurality of terminal holding groove 13 in a range except both end portions in the width direction thereof. The terminal groove 13 is disposed on the upper surface of the horizontal portion 11 in the width direction and has a slit shape opening in an upper direction. The terminal holding groove 13 holds the terminal 20. Further, the housing 10 includes a metal fitting holding groove 14 in the both end portions thereof. The metal fitting holding groove 14 holds the metal fitting 30.

In addition, the housing 10 includes a regulation member supporting surface 15. The regulation member supporting surface 15 is situated between where the terminals 20 are disposed and the metal fitting holding groove 14 in the width direction. The regulation member supporting surface 15 includes a surface concaved as an inner surface of a cylinder having an axis in the direction of the arrow A, or in a direction the conductive member F is inserted. The regulation member supporting surface 15 is situated in both end portions so as to be symmetrical in the width direction. The regulation member supporting surface 15 supports the regulation member 50 so as to be rotatable around the axis described above.

In the embodiment, the terminal 20 held in the terminal holding groove 13 of the housing 10 is made from a metal plate. The terminal 20 is provided by punching out the metal plate so as to maintain a flat surface of the metal plate. The terminal 20 is partially pressed into the terminal holding groove 13 having a width corresponding to a thickness of the metal plate, thereby being held in the terminal holding groove 13. The terminal 20 includes an elastic arm portion (not shown) having elasticity. The elastic arm portion includes a contact portion 21 having a protruding shape. The contact portion 21 protrudes from the upper surface of the horizontal portion 11 of the housing 10 in the upper direction. The terminal 20 further includes a connecting portion (not shown) extending from a rear end of the housing 10. The connecting portion is soldered to a corresponding circuit portion on a circuit board (not shown) on which the connector 1 is arranged.

Similar to the terminal 20, the metal fitting 30 is provided by punching out a metal plate so as to maintain a flat surface of the metal plate. The metal fitting 30 is inserted forcibly so as to be held in the metal fitting holding groove 14 provided in the both ends of the housing 10 outside of the range in which the terminal 20 is disposed. The metal fitting 30 includes a fixing portion 31 extending along a cut-off side surface of the horizontal portion 11 of the housing 10.

In the embodiment, the fixing portion 31 is soldered to a corresponding circuit portion of the circuit board. The metal fitting 30 further includes a supporting portion 32. The supporting portion 32 is situated a rear side of the fixing portion 31 and protrudes in the upper direction from the horizontal portion 11 of the housing 10. The supporting portion 32 supports a side end wall portion 41 of the movable member 40 so as to be rotatable back-and-forth freely. As described later, the movable member 40 is also supported by the terminal 20 so as to be freely rotatable back-and-forth.

In the embodiment, the movable member 40 is supported by a supporting portion 32 of the metal fitting 30 so as to be freely rotatable. The movable member 40 is rotated back and forth between the open position as standing uprightly as shown in FIG. 1(A) and the closed position as laying along the horizontal portion 11 as shown in FIG. 1(B). As shown in FIG. 1(A), the movable member 40 includes a groove portion 42 at a position corresponding to the terminal 20 in the width direction of the housing 10. The groove portion 42 allows a supporting arm portion (not shown) of the terminal 20 to enter therein. The movable member 40 further includes a shaft portion (not shown) provided insularly so as to connect inner surfaces of the groove portion 42 facing each other.

In the embodiment, the supporting arm portion of the terminal 20 supports the shaft portion with a concaved portion thereof so that the movable member is able to be rotated freely. In FIG. 1(A), the groove portion 42 is situated in a lower portion of the movable member 40. An upper portion of the movable member 40 standing uprightly works as an operating portion 43 for rotation of the movable member 40. The movable member 40 further includes a pressurizing portion 40A for pressing the flat conductive member F from the upper direction at the closed position. The pressurizing portion 40A is situated in the lower portion of the movable member 40, that is, an opposite side of the operating portion 43.

Figure 2B:
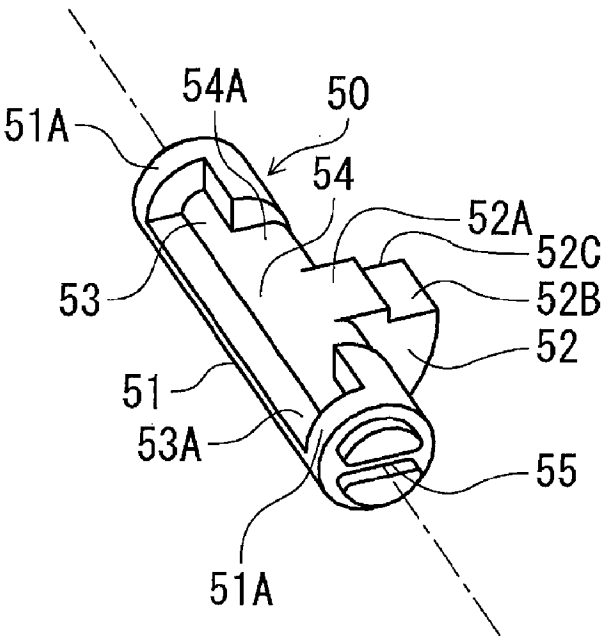
Figure 2A:
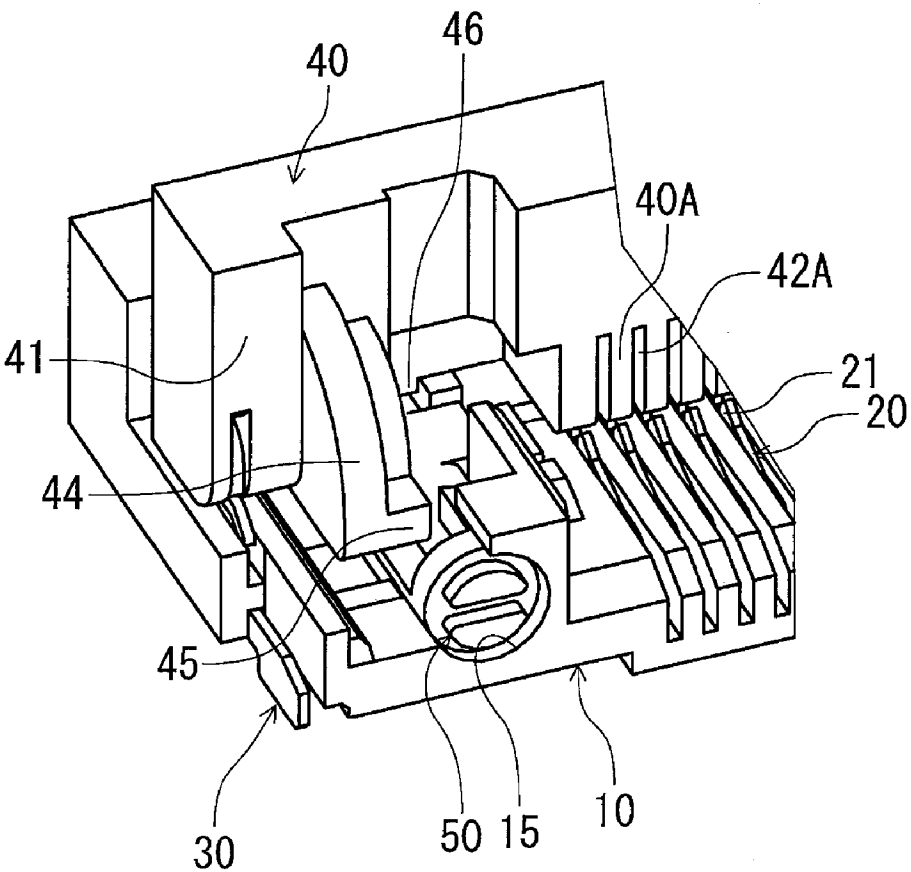

In the embodiment, the movable member 40 includes a pressing portion 44 being cooperated with the regulation member 50 described later. As shown in FIG. 2(A), the pressing portion 44 is situated in a lower portion of an inner side of the side end wall portion 41 of the movable member 40 and partially protrudes forward from the side end wall portion 41.

Figure 3C:
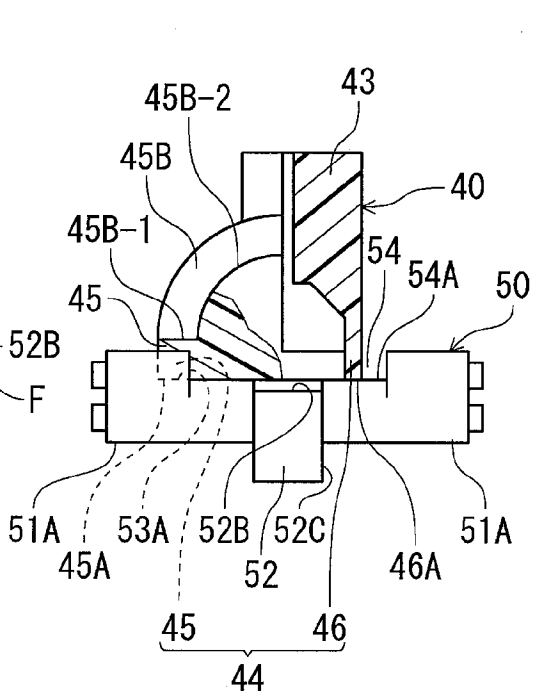
Figure 3B:
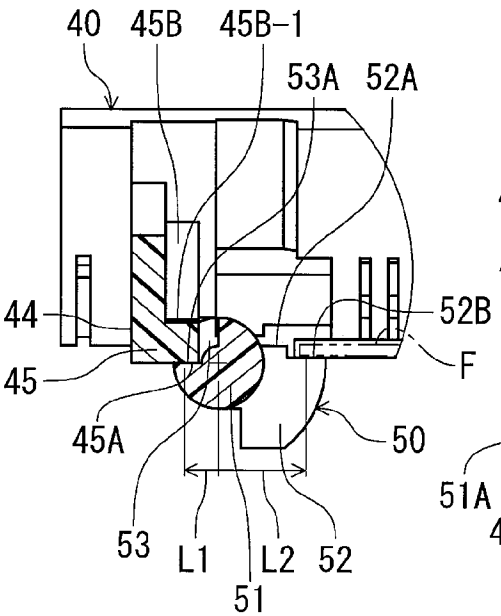
Figure 3A:
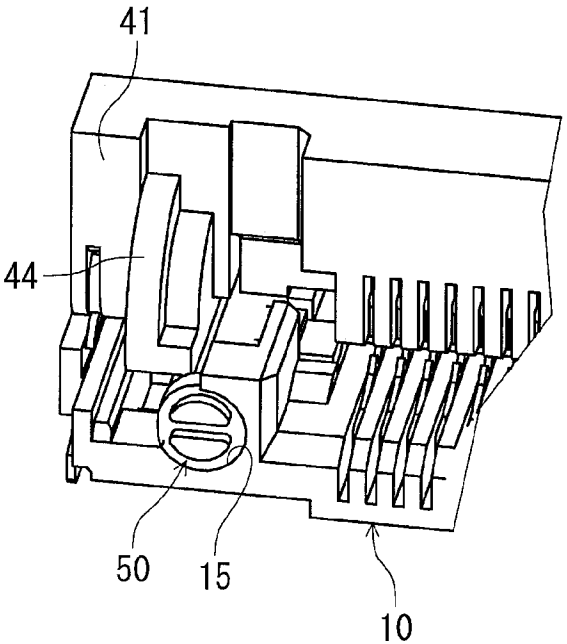

As shown in FIG. 3(C) showing the pressing portion 44 viewed from a middle position in the width direction, further, as shown in FIG. 3(A) showing a front view thereof from a slightly middle position in the width direction, the pressing portion 44 has a shape of a quarter circle around a pivot of the movable member 40. Further, the pressing portion 44 includes a front pressing portion 45 in a front portion thereof and a rear pressing portion 46 in a rear portion thereof.

In the embodiment, the pressing portion 44 is cooperated with the regulation member 50 extending in a front-rear direction as described later, being situated in a side end of the regulation member 50 in the width direction. The front pressing portion 45 includes a lower surface, and further an upper surface composing a tiered shape formed by partially cutting an upper end portion of an inner portion thereof.

As shown in FIGS. 3(B) and 3(C), the lower surface of the front pressing portion 45 lays flat in a lower end of the movable member 40 in the open position, forming a front pressing surface 45A for pressing a corresponding pressed surface of the regulation member 50. The movable member 40 is rotated around a middle portion of the pressing portion 44 in the front-rear direction. The upper surface of the front pressing portion 45 includes a front end flat surface 45B-1 formed by partially cutting the upper end portion of an inner portion of the front pressing portion 45 as described above, and an arc-shaped surface 45B-2.

In the embodiment, the arc-shaped surface 45B-2 extends from the front end flat surface 45B-1 in the upper direction. The front end flat surface 45B-1 and the arc-shaped surface 45B-2 form a receptacle space 45B having a shape of an arc in an upper side thereof. A rear pressing portion 46 is provided behind the front pressing portion 45. Further, the rear pressing portion 46 is situated in a rear side of the pivot of the movable member 40. The rear pressing portion 46 is formed by extending a rear end portion of the movable member 40 in the lower direction and includes a rear pressing surface 46A situated as a lower end surface thereof in the same position in a vertical direction with the front pressing surface 45A. The rear pressing surface 46A is situated closer to where the terminal 20 are disposed than the front pressing surface 45A and reaches an inner side of the axis of the regulation member 50.

As shown in FIG. 2(A), the regulation member 50 is supported by a regulation member supporting surface 15 of the housing 10 so as to be rotatable around an axis thereof. The axis of the regulation member 50 extends in the front-rear direction. Further, as shown in FIG. 2(B) showing the regulation member 50 only, the regulation member 50 includes a shaft portion 51 and a wing portion 52 protruding from the shaft portion 51 in a radius direction.

In the embodiment, the regulation member 50 has a shape symmetrical with respect to the front-rear direction. The regulation member 50 includes a supported portion 51A situated on both ends in the front-rear direction of the shaft portion 51. The supported portion 51A forms an outer circumferential surface of the regulation member 50. Further, the regulation member 50 includes an axial concave portion 53 and a tangential concave portion 54 situated between the supported portions 51A on both ends thereof, in a region which is partially cut-off in a circumferential direction.

In the embodiment, the axial concave portion 53 extends in an axial direction and lays in a partial region in the circumferential direction. The tangential concave portion 54 is situated in a middle portion in the axial direction and extends from the axial concave portion 53 in a tangential direction. The wing portion 52 substantially extends a surface thereof from a surface of the tangential concave portion 54 in the tangential direction. The axial concave portion 53 includes a pressed portion 53A in a front portion of a wall thereof extending in the direction of axis and the radius direction situated farther from the wing portion 52.

Additionally, the tangential concave portion 54 includes a returning pressed portion 54A in a rear portion of a surface thereof. A surface extending from the tangential concave portion 54 forms one of end surfaces of the wing portion 52 in the circumferential direction. The wing portion 52 includes a protrusion protruding in the radius direction with a fan-like shape in a range of 90 degrees in the circumferential direction. The end surface of the wing portion 52 extending from the tangential concave portion 54 has a shape tiered in a middle in the radius direction. The end surface is composed of two surfaces forming the tiered shape.

One of the surfaces 52A extending from the tangential concave portion 54 is situated in the same level with the tangential concave portion 54. Other of the surfaces situated outside in the radius direction forms an abutting portion 52B. The abutting portion 52B is situated lower than the surface 52A and in the same level with the horizontal portion 11. The abutting portion 52B is capable of abutting against a lower surface of the flat conductive member F.

As shown in FIG. 3(B), the abutting portion 52B is utilized as a guide of the flat conductive member F as the flat conductive member F is inserted. Further, the tiered shape formed with the surface 52A and the abutting member 52B is utilized for regulating a position of a side end of the flat conductive member F in the width direction as being in the same position with an inner wall of the housing 10. Furthermore, a rear end surface of the wing portion 52 is utilized as an engaging portion 52C for engaging an engaged cut-off portion F1 of the flat conductive member F.

In addition, the regulation member 50 includes a groove portion 55 in each of surfaces of front and rear in the axial direction. The groove portion 55 is formed between protrusions of a substantial semicircular shape.

In the embodiment, the regulation member 50 configured as described above, functions together with the housing 10 and movable member 40 as described below.

As described above, the regulation member 50 is supported by the housing 10 so as to be rotatable around the axis thereof back-and-forth freely, as the outer circumferential surface of the supported portion 51A situated in both ends in the axial direction thereof is supported by the regulation member supporting surface 15 of the housing 10.

As shown in FIGS. 2(A), 3(A) to 3(C), the regulation member 50 thus supported by the housing 10 is situated so that the pressed portion 53A thereof contacts or closely faces the front pressing surface 45A on the lower surface of the front pressing portion 45 of the movable member 40 in the open position. Further, the returning pressed portion 54A of the regulation member 50 is situated so as to contact or closely face the rear pressing surface 46A of the movable member 40 in the open position.

In addition, the wing portion 52 of the regulation member 50 is situated in a position corresponding to the engaged cut-off portion F1 of the flat conductive member F in the front-rear direction, that is, side of the engaged cut-off portion F1, as the flat conductive member F is inserted to a regular position. Further, the abutting portion 52B of the wing portion 52 is situated in a position lower than the lower surface of the flat conductive member F in the vertical direction.

According to the embodiment, the connector 1 thus configured is utilized as described below.

(1) First, the connector 1 is arranged in a corresponding position on the circuit board. The connector 1 is fixed on the circuit board by soldering the connecting portion of the terminal 20 and the fixing portion 31 of the metal fitting 30 thereof to the corresponding circuit portions, respectively.

(2) Upon connecting the connector 1 to the flat conductive member F, the movable member 40 is stood to set in the open position as shown in FIGS. 1(A), 2(A), 3(A) and 3(C). When the movable member 40 is in the open position, the returning pressed portion 54A of the regulation member 50 is pressed in the lower direction by the rear pressing surface 46A of the rear pressing portion 46 of the movable member 40. Therefore, as shown in FIGS. 3(A) to 3(C), the regulation member 50 is situated in a first position by rotating clockwise.

In the first position, the abutting portion 52B of the wing portion 52 is situated lower than where the flat conductive member F is inserted. As shown in FIG. 3(C), the front pressing surface 45A of the front pressing portion 45 contacts or closely faces the pressed portion 53A of the regulation member 50.

(3) When the movable member 40 is in the open position and the regulation member 50 is in the first position respectively, the flat conductive member F is inserted into the receptacle portion 11A of the housing 10 easily since no obstacle against the insertion of the flat conductive member F is present. When the flat conductive member F is supposed to be inserted to the regular position, the movable member 40 is rotated to the closed position.

When the flat conductive member F is in the regular position, the engaged cot-off portion F1 is situated in a position corresponding to the wing portion 52 of the regulation member 50 in the front-rear direction. As the movable member 40 is rotated to the closed position, the front pressing portion 45 of the movable member 40 presses the pressed portion 53A of the regulation member 50 in the lower direction. The movable member 50 rotates around the axis thereof counter-clockwise as the pressed portion 53A thereof is pressed in the lower direction, since the pressed portion 53A is situated in a position apart from the axis of the regulation member 50 by a certain distance in the radius direction.

Figure 4B:
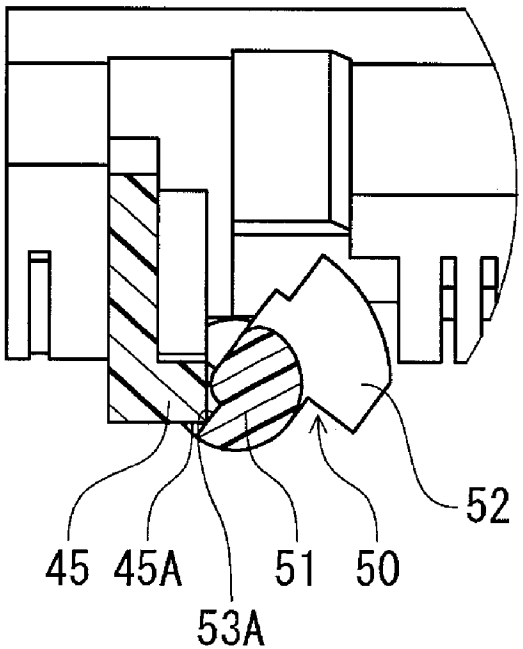
Figure 4A:
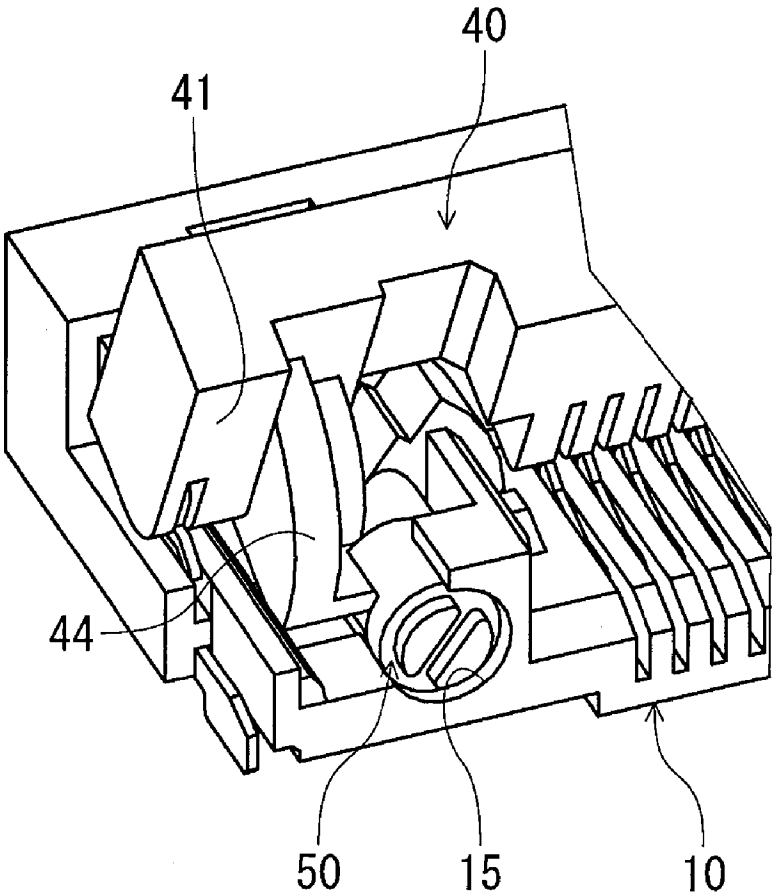
Figure 5C:
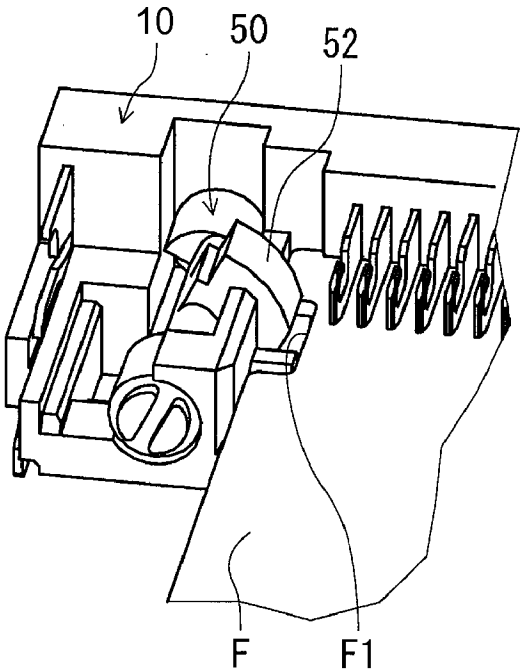
Figure 5B:
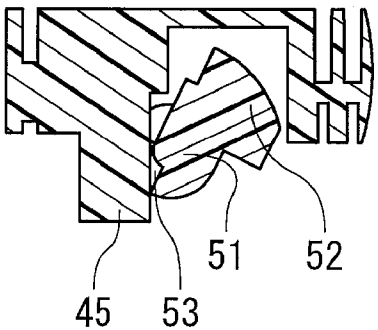
Figure 5A:
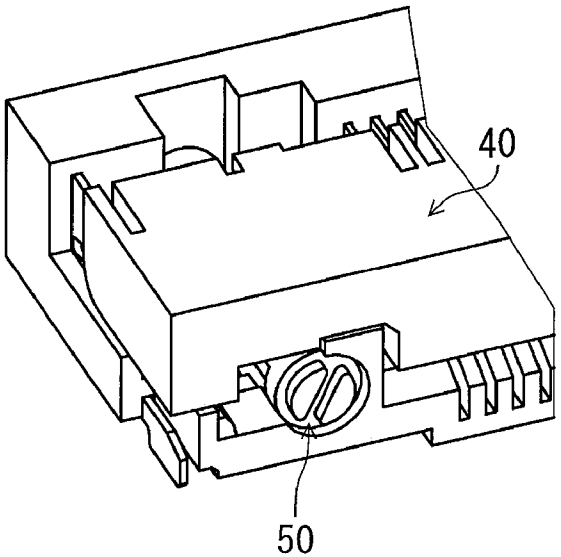

In the embodiment, the movable member 50 rotates to a state shown in FIGS. 5(A) to 5(C) (in FIG. 5(C), the movable member 40 is not shown) through a state shown in FIGS. 4(A) and 4(B). FIG. 4(B) is a sectional view of the movable member 50 taken along where the pressed portion 53A is situated in the front-rear direction and FIG. 5(B) is a sectional view of the movable member 50 taken along where the wing portion 52 is situated in the front-rear direction, respectively. The pressed portion 53B is situated in front of the wing portion 52. The regulation member 50 rotates as long as the front pressing portion 45 contacts the pressed portion 53A thereof.

When the front pressing portion 45 is moved in the lower direction and stops contacting the pressed portion 53A, the regulation member 50 stops rotating. When the regulation member 50 stops rotating, the regulation member 50 is in a second position. When the regulation member 50 rotates to the second position, the wing portion 52 thereof enters the engaged cut-off portion F1 of the flat conductive member F from the lower direction in the case of the flat conductive member F is properly inserted to the regular position as an operator assumes.

When the regulation member 50 is in the second position, the wing portion 52 thereof is situated in a position interfering with the flat conductive member F in the regular position at an edge portion of the engaged cut-off portion F1 of the flat conductive member F. Accordingly, the flat conductive member F is not extracted by being engaged the engaging portion 52C, which is the rear end surface of the wing portion 52 when the flat conductive member F is pulled to be extracted.

Further, the flat conductive member F is pressed in the lower direction in a region where the terminal 20 is arranged, by the pressurizing portion 40A of the movable member 40 in the closed position. Therefore, when the flat conductive member F is pulled to be extracted is not able to be twisted between wing portions 52 of the two regulation members 50. As a result, the flat conductive member F maintains a state specified to be connected the terminal 20 since the engaged cut-off portion F1 thereof maintains a state being engaged the engaging portion 52C of the wing portion 52.

(4) Next, when the flat conductive member F is not sufficiently inserted to the regular position as opposed to assuming of the operator, that is, the engaged cut-off portion F1 of the flat conductive member F is situated in front side of the wing portion 52 of the regulation member 50, a distal end portion F2 of the flat conductive member F is situated in the position corresponding to the wing portion 52.

When the operator rotates the movable member 40 to the closed position, wrongly assuming that the flat conductive member F is in the regular position, the abutting portion 52B of the wing portion 52 abuts against a lower surface of the distal end portion F2 of the flat conductive member F instead of the engaged cut-off portion F1 of the flat conductive member F. Therefore, the flat conductive member F is pressed as if being sheared with the pressurizing portion 40A.

As a result, the regulation member 50 is unable to reach the second position since the abutting portion 52B is not able to move in the upper direction further, preventing the regulation member 50 from rotating further in a halfway. Accordingly, the front pressing portion 45 of the movable member 40 pressing the pressed portion 53A of the regulation member 50 in the lower direction is unable to move in the lower direction further.

Therefore, the movable member 40 is not able to reach the closed position. The operator visually recognizes the position of the movable member 40 as not being in the closed position to know that the flat conductive member F is not in the regular position. Then the operator is able to retry to insert the flat conductive member F.

In the embodiment, distance L1 between the axis and the pressed portion 53A of the regulation member 50 is smaller than distance L2 between the axis and the abutting portion 52B of the regulation member 50 (as shown in FIG. 3(B)). Accordingly, it is very difficult to rotate the regulation member 50 by pressing the pressed portion 53A in the lower direction with the movable member 40 resisting a force which the abutting portion 52B receives from the flat conductive member F.

(5) Next, when the flat conductive member F having been inserted is extracted, the movable member 40 is returned to the open position. As shown in FIG. 5(C), when the flat conductive member F is inserted to the regular position and the wing portion 52 of the regulation member 50 is situated in the engaged cut-off portion F1 of the flat conductive member F, the movable member 40 is in the closed position. Accordingly, the front pressing portion 45 of the movable member 40 pressing the pressed portion 53A of the regulation member 50 in the lower direction is situated in the lowest position as shown in FIG. 5(B), not contacting the pressed portion 53A.

As the movable member 40 is rotated from the closed position to the open position, the front pressing portion 45 of the movable member 40 shown in FIG. 5(B) moves in the upper direction to raise an upper inner surface of the axial concave portion 53 with an edge portion of the upper surface thereof. Thereby, the regulation member 50 shown in FIG. 5(B) rotates clockwise so as to return to the first position.

As the front pressing portion 45 moves in the upper direction further to be apart from the axial concave portion 53, the front pressing portion 45 is no longer capable of rotating the regulation member 50. Instead, the rear pressing portion 46 shown in FIG. 3(C) presses the returning pressed portion 54A of the regulation member 50 in the lower direction as the movable member 40 is rotated to the open position. As a result, the regulation member 50 rotates further to return to the first position shown in FIG. 3(C) completely. At the same time, the movable member 40 also returns to the open position.

Second Embodiment

Next, a second embodiment of the present invention will be explained with reference to FIGS. 6 and 7(A) to 7(C). As compared to the first embodiment in which the regulation member 50 is rotatable around the axis extending in the front-rear direction or a direction the flat conductive member F is inserted and extracted, in the second embodiment as shown in FIGS. 6 and 7(A) to 7(C), the regulation member is rotatable around an axis X (shown in FIGS. 7(A) to 7(C)) extending in the width direction of the flat conductive member.

Figures 7A, 7B, 7C, 7D:
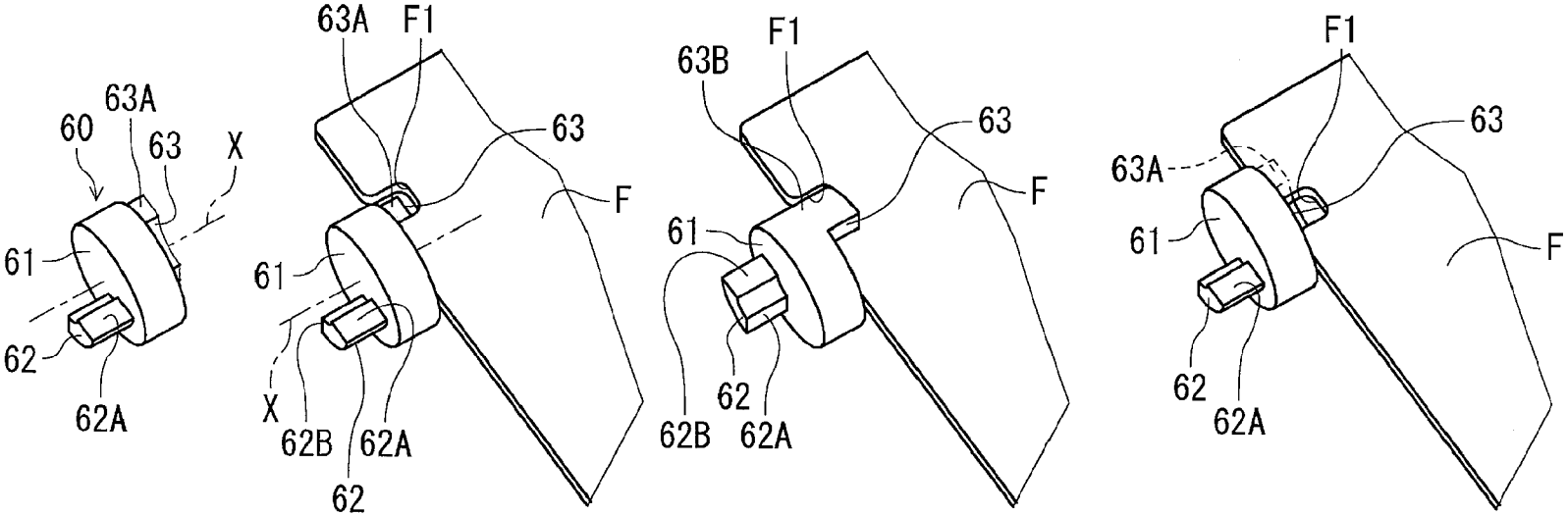

In the embodiment, as shown in FIGS. 7(A) to 7(C), the regulation member 60 includes a rotating plate portion 61 with a disk shape having the axis X extending in the width direction of the flat conductive member F; a first protrusion 62; and the second protrusion 63. Each of the first protrusion 62 and the second protrusion 63 protrudes in the direction of the axis X from each of bottom surfaces of the rotating plate portion 61 at a different position in a circumference thereof, respectively.

As shown in FIG. 7(A), the first protrusion 62 and the second protrusion 63 are situated in positions opposite to each other in a radius direction. Further, the first protrusion 62 and the second protrusion 63 have partial cylindrical shapes cut off so as to have predetermined angles around the axis X in a circumferential direction, respectively. Furthermore, the first protrusion 62 and the second protrusion 63 have a flat side surface on both ends in the circumferential direction, respectively.

Figure 6:
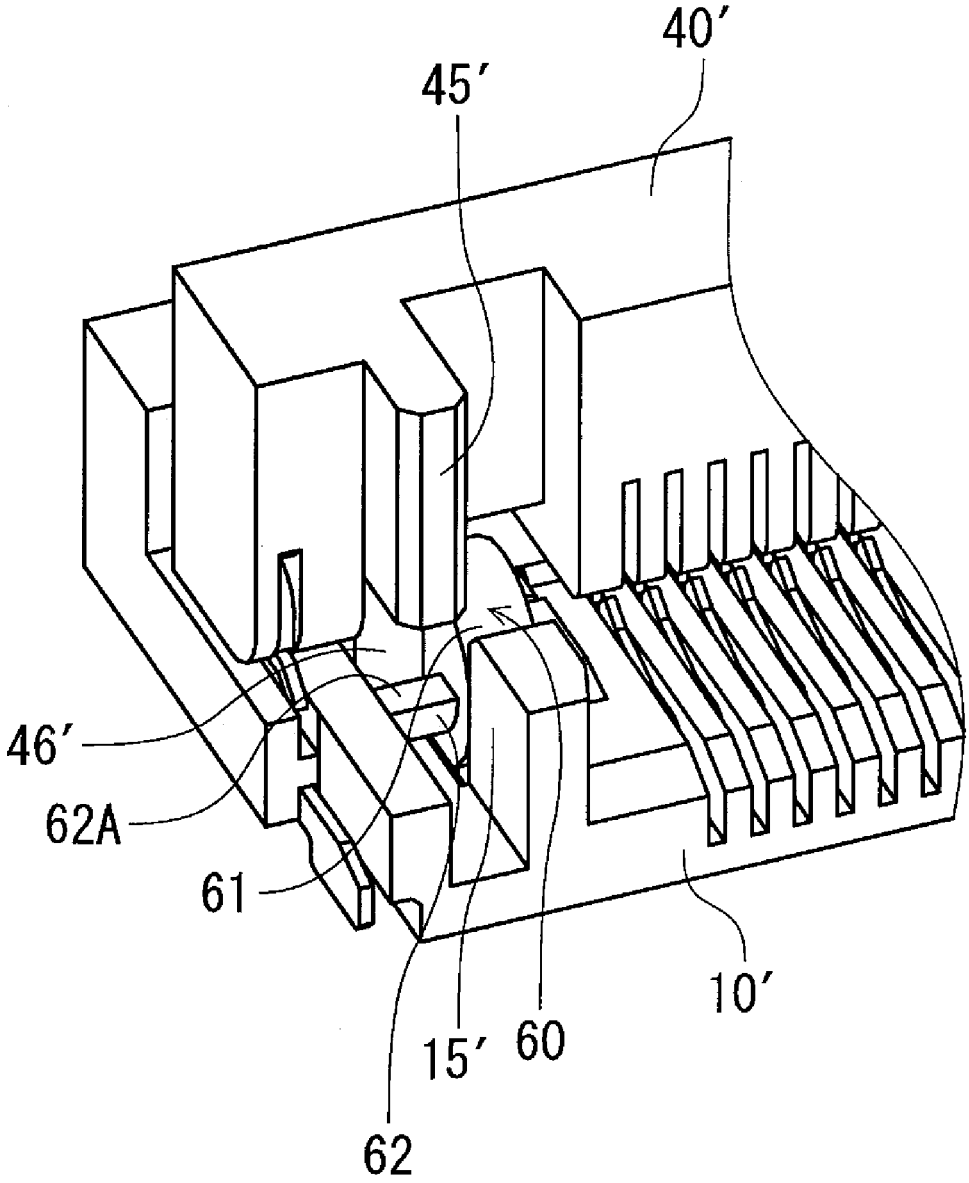
FIG. 6 is a partial perspective view showing an electrical connector according to a second embodiment of the present invention.

As shown in FIGS. 7(B) and 7(C), the rotating plate portion 61 of the regulation member 60 is situated beside the flat conductive member F inserted into the regular position, being supported with an outer circumferential surface thereof by a housing 10' as shown in FIG. 6, so as to be freely rotatable.

Further, when the regulation member 60 is rotated around the axis X, the second protrusion 63 is situated in a position being capable of entering into the engaged cut-off portion F1 of the flat conductive member F. The first protrusion 62 includes a pressed portion 62A in a side edge surface of an upper side thereof. The pressed portion 62A is pressed by a front pressing portion 45' of the movable member 40'. The second protrusion 63 includes an abutting portion 63A for abutting against the lower surface of the flat conductive member F in a side edge surface of an upper side thereof.

In the embodiment including the regulation member 60 thus configured, as shown in FIG. 6, a regulation member supporting surface 15' of the housing 10' supports the outer circumferential surface of the rotation plate portion 61 of the regulation member 60 so as to be rotatable around the axis X. The regulation member 60 rotates around the axis X as the front pressing portion 45' of the movable member 40' moving from the open position to the closed position presses the pressed portion 62A of the first protrusion 62 in the lower direction. Thereby, the abutting portion 63A of the second protrusion 63 moves in the upper direction.

In the embodiment, when the flat conductive member F is inserted to the regular position, the pressed portion 62A of the first protrusion 62 is pressed in the lower direction by the front pressing portion 45' of the movable member 40'. As a result, the second protrusion 63 moves in the upper direction as changing from a state shown in FIG. 7(B) to a state shown in FIG. 7(C).

Accordingly, the second protrusion 63 enters the engaged cut-off portion F1 of the flat conductive member F. Thereby, it is possible to prevent the flat conductive member F in the regular position from being extracted inadvertently. Accordingly, an outer circumferential surface of the second protrusion 63B forms an engaging portion for preventing the flat conductive member F from being extracted inadvertently.

Next, when the flat conductive member F is not in the regular position due to incomplete insertion, as shown in FIG. 7(D), the lower surface of the flat conductive member F is abutted by the abutting portion 63A situated in the side edge surface of an upper side of the second protrusion 63 moved in the upper direction. Thereby, the regulation member 60 is not able to rotate further. As a result, the movable member 40' is not able to move to the closed position as well.

In the embodiment, similar to the first embodiment, it is possible to prevent the movable member from moving to the closed position more certainly by setting a distance between the axis X and the second protrusion 63 greater than a distance between the axis X and the first protrusion 62.

When the movable member 40' is returned to the open position from the closed position as the flat conductive member F is inserted to the regular position or from a halfway to the closed position as the flat conductive member F is inserted incompletely, a rear pressing portion 46' of the movable member 40' moves from the closed position to the open position as shown in FIG. 6 after moving forward by being rotated around a rotation axis to the open position from the closed position.

In the closed position, the rear pressing portion 46' is situated a rear side of the rotation axis. As a result, a second pressed portion 62B is pressed by the rear pressing portion 46', thereby the regulation member 60 rotates so that the pressed portion 62A moved in the upper direction. As shown in FIGS. 7(B) and 7(C), the second pressed portion 62B is formed in the first protrusion 62 of the regulation member 60' and situated in an opposite side of the pressed portion 62 in the circumferential direction. Accordingly, as the pressed portion 62A is thus rotated, the abutting surface 63A of the second protrusion 63 moves in the lower direction. Therefore, the regulation member 60' returns to an initial position and the flat conductive member F is able to be extracted easily.

Third Embodiment

Figure 8:
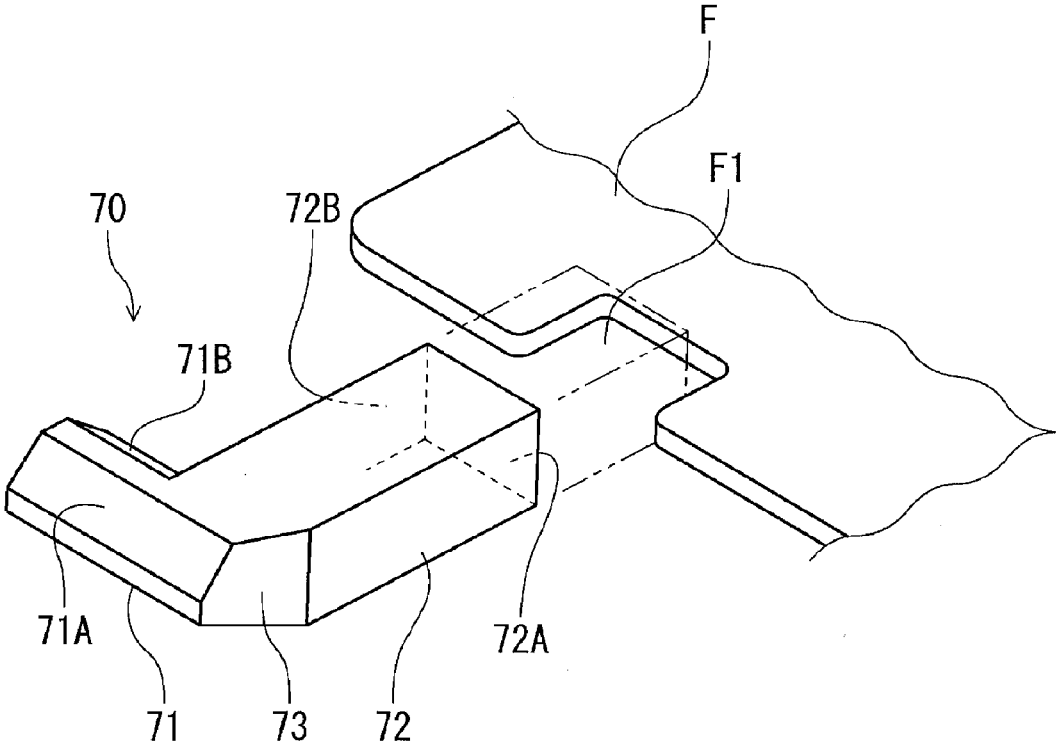
FIG. 8 is a perspective view showing a regulating member of an electrical connector and a flat conductive member according to a third embodiment of the present invention.

A third embodiment of the present invention will be explained next with reference to FIG. 8. As shown in FIG. 8, a regulation member 70 is not a rotatable member capable of being rotated around an axis. The regulation member 70 is capable of moving lineally.

In the embodiment, the regulation member 70 has an L-letter shape as a whole and situated in lateral of the flat conductive member F.

The regulation member 70 includes a longitudinal portion 71 extending in the direction the flat conductive member F is inserted and extracted and a lateral portion 72 extending in the width direction so as to be perpendicular to the longitudinal portion 71. The regulation member 70 is supported by a housing so as to be capable of moving lineally in the width direction. The lateral portion 72 has a rectangular cross-sectional shape with a size being able to enter in the engaged cut-off portion F1 of the flat conductive member F in the regular position as shown in a dashed line in FIG. 8 upon moving in the width direction.

As shown in a solid line in FIG. 8, the regulation member 70 is able to move lineally between a first position prior to move in the engaged cut-off portion F1 and a second position after moving in the engaged cut-off portion F1 shown in the dashed line in FIG. 8. A distal end surface of the lateral portion 72 facing the engaged cut-off portion F1 functions as an abutting portion 72A of the regulation member 70.

In the embodiment, the regulation member 70 includes slopes in upper surfaces of the both ends of the longitudinal portion 71 and an outer upper surface in a corner portion of a transforming portion from the longitudinal portion 71 to the lateral portion 72, respectively. The slope 71A formed in the longitudinal portion 71 is situated at a position being apart from the flat conductive member F and the slope 73 on the corner portion of the transforming portion function as a pressed portion. The pressed portion is pressed by the front pressing portion 45 of the movable member 40.

In the embodiment, the slope 71A and the slope 73 are irregularly connected to each other. Instead, the slopes may be connected smoothly. In addition, a slope 71B formed in the longitudinal portion 71 and situated close to the flat conductive member F functions as a returning pressed portion 71B for being pressed by other pressing portion situated in a different position from the front pressing portion 45 of the movable member 40. The other pressing portion corresponds to the rear pressing portion of the movable member 40.

In the embodiment, the slope 71A of the longitudinal portion 71 and the slope 73 on the corner portion of the transforming portion are situated in a position being pressed in the lower direction by a front pressing surface 45A of the front pressing portion 45 as the front pressing portion 45 moves in the lower direction when the movable member 40 is moved to the closed position.

In the embodiment, the front pressing portion 45 moving in the lower direction starts to press the slope 73 in the lower direction. The front pressing portion 45 presses from the slope 73 to the slope 71A as moving lower. As slope 73 and the slope 71A is pressed by the front pressing member 45 sequentially, the regulation member 70 in the first position moves in the width direction toward the engaged cut-off portion F1 to reach the second position, being moved by a component in the lateral direction of a pressing force. When the regulation member 70 is in the second position, a rear surface of the lateral portion 72 is utilized as an engaging portion 72B for preventing the flat conductive member F from being extracted.

In the embodiment, the returning pressed portion 71B is pressed in the lower direction by the other pressing portion of the movable member 40 when the regulation member 70 is in the second position. Thereby, the lateral portion 72 moves from the engaged cut-off portion F1 in the width direction by a component in the lateral direction of a pressing force. As a result, the regulation member 70 returns to the first position.

In the embodiment, when the flat conductive member F is inserted incompletely, on the way to the second position, the abutting portion 72A of the lateral portion 72 of the regulation member 70 abuts against a side edge of the flat conductive member F, situated in a front side of the engaged cut-off portion F1. Therefore, the regulation member 70 stops in a halfway to the second position, being unable to reach the second position. Accordingly, the movable member 40 is unable to move in the lower direction further, since the front pressing portion 45 thereof presses the slope 73 or the slope 71A as the pressed portion.

In the present invention, the flat conductive member includes the engaged cut-off portion having an open-ended shape in the embodiments shown in the drawings. Instead, the engaged cut-off portion may have a window-like shape. The present invention is able to be applied effectively when the engaged cut-off portion may have the window-like shape as well. In addition, the regulation member may be supported by a member attached to the housing, instead of being supported directly by the housing.

The disclosure of Japanese Patent Application No. 2011-108404 filed on May 13, 2011, is incorporated in the application by reference.

While the invention has been explained with reference to the specific embodiments of the invention, the explanation is illustrative and the invention is limited only by the appended claims.

What is claimed is:

1. An electrical connector for connecting a flat conductive member, comprising:

a housing having a receiving portion for receiving the flat conductive member;

a terminal disposed in the housing, said terminal including a contact portion for contacting with the flat conductive member;

a movable member disposed to be movable between an opened position and a closed position so that the flat conductive member can be inserted into the receiving portion when the movable member is situated at the opened position and the movable member presses the flat conductive member against the contact portion when the movable member is situated at the closed position; and a regulating member supported on the housing to be movable between a first position and a second position so that the flat conductive member can be inserted into the receiving portion when the regulating member is situated at the first position, wherein said regulating member includes a pressed portion to be pressed with the movable member and an abutting portion for abutting against the flat conductive member when the regulating member is situated between the first position and the second position so that the regulating member restricts a movement of the movable member toward the closed position.

2. The electrical connector according to claim 1, wherein said regulating member includes a shaft portion arranged to be rotatable around an axial line thereof and a wing portion extending from the shaft portion in a radial direction of the shaft portion, said shaft portion including a step portion as the pressed portion, said wing portion including a surface facing the flat conductive member as the abutting portion.

3. The electrical connector according to claim 1, wherein said regulating member includes a rotational plate member arranged to be rotatable around an axial line thereof, a first protruding portion extending from the rotational plate member along the axial line at a first position shifted from the axial line in a radial direction of the rotational plate member, and a second protruding portion extending from the rotational plate member along the axial line at a second position shifted from the axial line in the radial direction, said first protruding portion including the pressed portion, said second protruding portion including the abutting portion.

4. The electrical connector according to claim 1, wherein said regulating member includes a plate portion for entering an engaging recess portion of the flat conductive member when the regulating member moves from the first position to the second position.

5. The electrical connector according to claim 1, wherein said regulating member includes an engaging portion for engaging with an engaging recess portion of the flat conductive member when the regulating member moves from the first position to the second position.

6. An electrical connector for connecting a flat conductive member, comprising:

a housing having a receiving portion for receiving the flat conductive member;

a terminal disposed in the housing, said terminal including a contact portion for contacting with the flat conductive member;

a movable member disposed to be movable between an opened position and a closed position so that the flat conductive member can be inserted into the receiving portion when the movable member is situated at the opened position and the movable member presses the flat conductive member against the contact portion when the movable member is situated at the closed position; and a regulating member supported on the housing to be movable so that the flat conductive member can be inserted into the receiving portion when the movable member is situated at the opened position, wherein said regulating member includes a pressed portion and an abutting portion so that the movable member presses the pressed portion and the abutting portion enters the receiving portion when the movable member moves from the opened position to the closed position.

7. An electrical connector for connecting a flat conductive member, comprising:

a housing having a receiving portion for receiving the flat conductive member;

a terminal disposed in the housing, said terminal including a contact portion for contacting with the flat conductive member;

a movable member disposed to be movable between an opened position and a closed position so that the flat conductive member can be inserted into the receiving portion when the movable member is situated at the opened position and the movable member presses the flat conductive member against the contact portion when the movable member is situated at the closed position; and a regulating member supported on the housing to be movable so that the flat conductive member can be inserted into the receiving portion when the movable member is situated at the opened position, wherein said regulating member includes a return pressed portion so that the movable member presses the return pressed portion to move the regulating member when the movable member moves from the closed position to the opened position.

* * * * *